US006386325B1

(12) United States Patent
Fujita

(10) Patent No.: US 6,386,325 B1
(45) Date of Patent: May 14, 2002

(54) ELEVATOR SYSTEM WITH HALL SCANNER FOR DISTINGUISHING BETWEEN STANDING AND SITTING ELEVATOR PASSENGERS

(75) Inventor: Masao Fujita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/735,654

(22) Filed: Dec. 14, 2000

(30) Foreign Application Priority Data

Apr. 19, 2000 (JP) ..... 2000-117708

(51) Int. Cl.[7] ..... B66B 13/14
(52) U.S. Cl. ..... 187/316; 187/380; 187/392
(58) Field of Search ..... 187/316, 380, 187/317, 391, 392, 393, 901

(56) References Cited

U.S. PATENT DOCUMENTS 3,972,021 A * 7/1976 Leitz et al. ..... 340/38 P
4,555,724 A * 11/1985 Enriquez ..... 187/29 R
4,678,062 A * 7/1987 Sumka ..... 187/1 R
5,001,557 A * 3/1991 Begle ..... 187/132
5,182,776 A * 1/1993 Suzuki et al. ..... 187/132
5,284,225 A * 2/1994 Platt ..... 187/51
5,518,086 A * 5/1996 Tyni ..... 187/316

FOREIGN PATENT DOCUMENTS

JP 11-268879 10/1989
JP 10-330052 12/1998

* cited by examiner

*Primary Examiner*—Jonathan Salata
(74) *Attorney, Agent, or Firm*—Leydig, Voit & Mayer, Ltd.

(57) ABSTRACT

An elevator system includes a scanner installed in a call registerer of an elevator hall and/or on a jamb of an elevator hall for scanning the elevator hall or an area proximate the elevator hall; an image recognizing section for recognizing an image captured by the scanner unit; and operation mode selecting unit for switching an operation mode of the elevator based on recognition information supplied by the image recognizing section.

15 Claims, 9 Drawing Sheets

ELEVATOR SYSTEM WITH HALL SCANNER FOR DISTINGUISHING BETWEEN STANDING AND SITTING ELEVATOR PASSENGERS

BACKGROUND OF THE INVENTION

1. Field of the Invention

The present invention relates to an elevator system capable of registering calls, distinguishing between, for example, the able-bodied and passengers in wheelchairs, among passengers waiting at an elevator hall, and automatically switching an operation mode.

2. Description of Related Art

Japanese Unexamined Patent Publication No. 11-268879 discloses a method wherein two cameras scan, from a ceiling, passengers waiting at an elevator hall, and captured images are subjected to image processing to detect top planar shapes and heights of the passengers, thereby discriminating the types of the passengers so as to switch an operation mode.

There is another example disclosed in Japanese Unexamined Patent Publication No. 10-330052. In this example, a wheelchair detector is incorporated in an elevator hall call button device to automatically recognize passengers in wheelchairs so as to register calls dedicated to passengers in wheelchairs. This arrangement makes it possible to combine pushbutton switches for upward call and downward call for passengers in wheelchairs with regular pushbutton switches, thereby eliminating the need for providing separate pushbutton switches for the passengers in wheelchairs that used to be installed at each floor level.

In the conventional passenger recognizing method described in the former publication, two cameras must be installed on a ceiling, requiring cumbersome construction including drilling holes in the ceiling, installing the cameras, and wiring. This would affect the design of the building wherein the elevator is installed, and require considerable efforts for installing and making adjustment of the cameras that would be carried out on the site.

In the conventional method described in the latter publication, the wheelchair detecting sensor is a metal detecting sensor, so that it inconveniently responds to metal of objects other than wheelchairs, making it difficult to perform accurate detection of wheelchairs.

SUMMARY OF THE INVENTION

The present invention has been made with a view toward solving the problem described above, and it is an object of the present invention to provide an elevator system that permits improved accuracy for recognizing passengers, easier installation, adjustment, and inspection, and automatic switching of an operation mode.

To this end, according to one aspect of the present invention, there is provided an elevator system including: scanning means for scanning a hall of an elevator or an area in the vicinity thereof; an image recognizing section for recognizing an image captured by the scanning means; and operation mode selecting means for switching an operation mode of the elevator based on recognition information supplied by the image recognizing section, wherein the scanning means is installed on a jamb of an elevator hall.

According to another aspect of the present invention, there is provided an elevator system including: scanning means for scanning a hall of an elevator or an area in the vicinity thereof; an image recognizing section for recognizing an image captured by the scanning means; and operation mode selecting means for switching an operation mode of the elevator based on recognition information supplied by the image recognizing section, wherein the scanning means is incorporated in a call registerer of an elevator hall.

According to another aspect of the present invention, there is provided an elevator system including: scanning means for scanning a hall of an elevator or an area in the vicinity thereof; an image recognizing section for recognizing an image captured by the scanning means; and operation mode selecting means for switching an operation mode of the elevator based on recognition information supplied by the image recognizing section, wherein the scanning means is incorporated in a call registerer of an elevator hall and a jamb of the elevator hall.

The scanning means and the image recognizing section may be adapted so that they are actuated when a passenger operates a hall call registerer.

The scanning means may be in constant operation regardless of whether a call has been registered, and may output a captured image directly from the elevator system to external equipment.

The image recognizing section may have means for transferring an image captured by the scanning means and the recognition information to external equipment.

The image recognizing section may have an image output terminal for outputting an image captured by the scanning means and the recognition information, the image output terminal being installed at a certain place of a hall portion of an elevator main body.

BRIEF DESCRIPTION OF THE DRAWINGS

FIGS. 2A and 2B show an elevator hall in a first embodiment in accordance with the present invention, wherein FIG. 2A is a front view, and FIG. 2B is a top plan view.

FIGS. 5A–5C show another elevator hall in the first embodiment in accordance with the present invention, wherein FIG. 5A is a front view, FIG. 5B is a top plan view, and FIG. 5C is a side view.

FIGS. 6A–6C show still another elevator hall in the first embodiment in accordance with the present invention, wherein FIG. 6A is a front view, FIG. 6B is a top plan view, and FIG. 6C is a side view.

FIGS. 8A and 8B show yet another elevator hall in the first embodiment in accordance with the present invention, wherein FIG. 8A is a front view and FIG. 8B is a top plan view.

FIGS. 9A and 9B show an elevator hall in a second embodiment in accordance with the present invention, wherein FIG. 9A is a front view, and FIG. 9B is a top plan view.

FIGS. 10A–10C show another elevator hall in the second embodiment in accordance with the present invention, wherein FIG. 10A is a front view, FIG. 10B is a top plan view, and FIG. 10C is a side view.

DESCRIPTION OF THE PREFERRED EMBODIMENTS

First Embodiment

Figure 1:
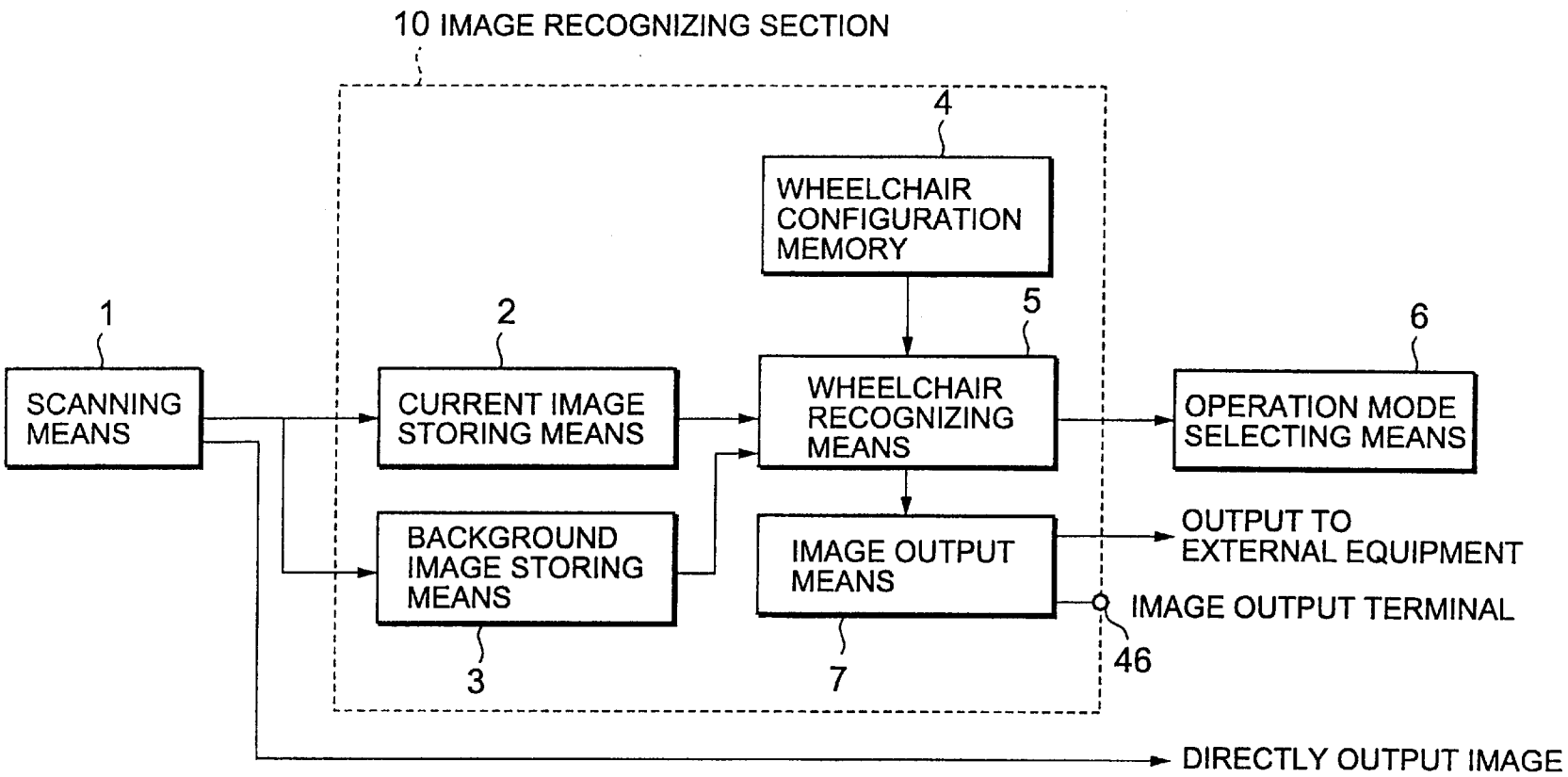
FIG. 1 is a block diagram of a control-related section common to all embodiments of an elevator system according to the present invention.

FIG. 1 is a block diagram of a control-related section common to all embodiments of an elevator system according to the present invention. In the drawing, image data input by a scanning means 1 formed of an image pickup device, such as a television camera or an artificial retina, is sent out to an image recognizing section 10, and a current image is stored in a current image storing means 2. Background images where no persons to be recognized is present are stored in a background image storing means 3 beforehand.

To recognize an elevator user, data regarding difference between image information taken out of the current image storing means 2 and image information taken out of the background image storing means 3 is compared with configuration information taken out of a wheelchair configuration memory 4 by a wheelchair recognizing means 5 thereby to determine whether the elevator user is a user in a wheelchair. The determination result is output to an operation mode selecting means 6. Further, image information can be output by an image output means 7 from an elevator system to external equipment.

Figure 2A:
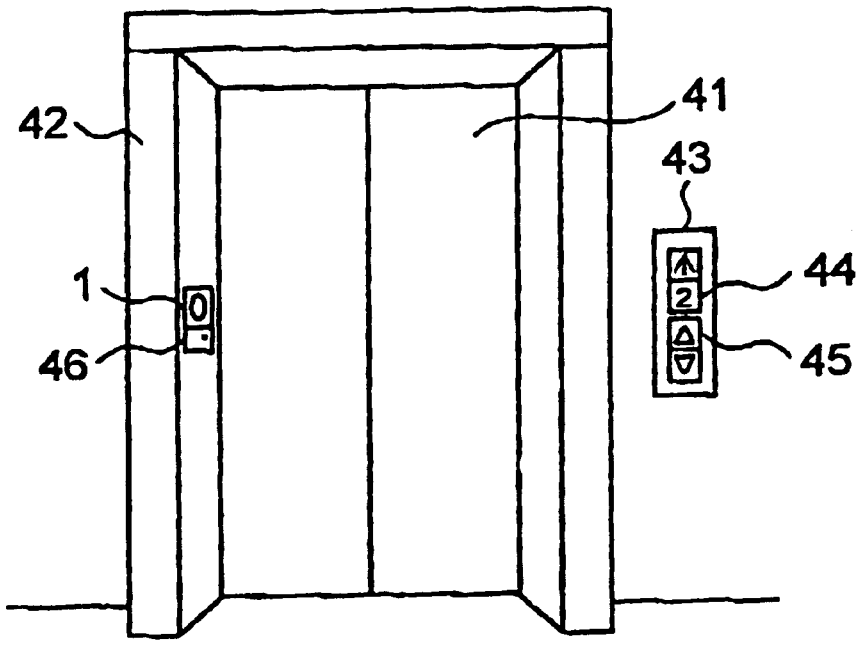
Figure 2B:
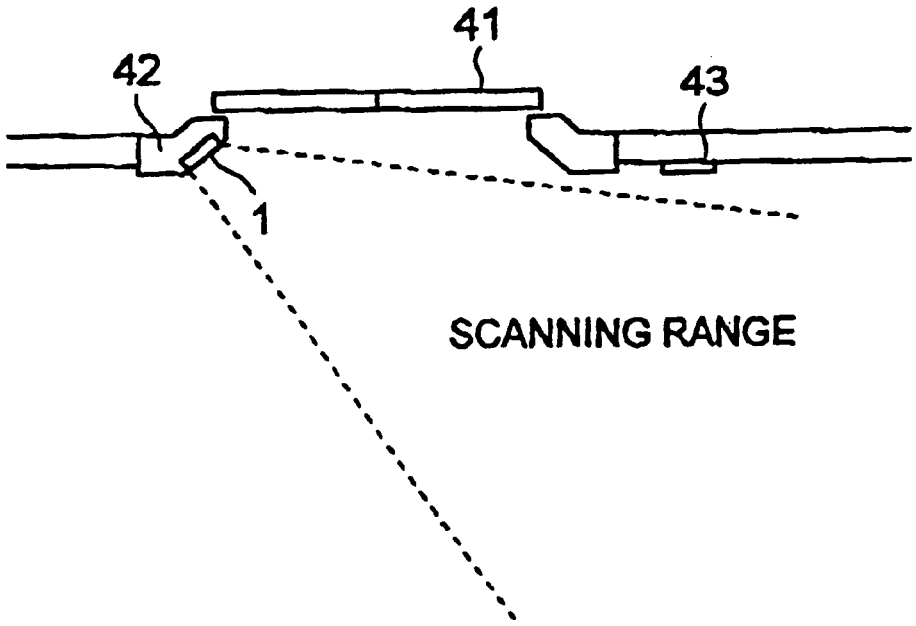

FIG. 2A is a front view of an elevator hall illustrating an example wherein the scanning means 1 is attached to a jamb of the elevator hall in the first embodiment according to the present invention, and FIG. 2B is a top plan view thereof.

In the drawings, a hall door 41, a hall jamb 42 surrounding the hall door 41, and a call registerer 43 are prepared on a wall surface. The call registerer 43 is furnished with direction lights for indicating a direction in which a car is traveling, a hall display 44 for indicating a position of the car, and a hall call button device 45 for registering a call for going up or down. The hall call button device 45 is configured so as to permit use by both able-bodied passengers and passengers in wheelchairs.

The scanning means 1 is provided on a vertical frame portion of the hall jamb 42 that is located opposite to the call registerer 43.

An operation of the first embodiment will now be described. The operation is started when a passenger operates the hall call button device 45. An image of the passenger who has operated the hall call button 45 is captured by the scanning means 1 and stored in the current image storing means 2. Then, the wheelchair recognizing means 5 performs image processing on the current image and background images that have been stored beforehand in the background image storing means 3, and extracts differential data.

Next, the differential data is compared with information regarding configurations of diverse types of wheelchairs that has been stored in the wheelchair configuration memory 4 in order to determine whether the passenger who has operated the hall call button device 45 is a passenger in a wheelchair.

If a determination result indicates that the passenger is in a wheelchair, then the information is output to the operation mode selecting means 6 in an operation controller. The operation controller controls the operation in a wheelchair operation mode that has been selected by the operation mode selecting means 6.

The scanning means 1 is installed on the vertical frame portion of the hall jamb 42 that is located opposite to the call registerer 43, and has a preset scanning range as illustrated in the top plan view of FIG. 2B. This arrangement enables the scanning means 1 to monitor passengers who have operated the hall call button device 45.

Figure 3:
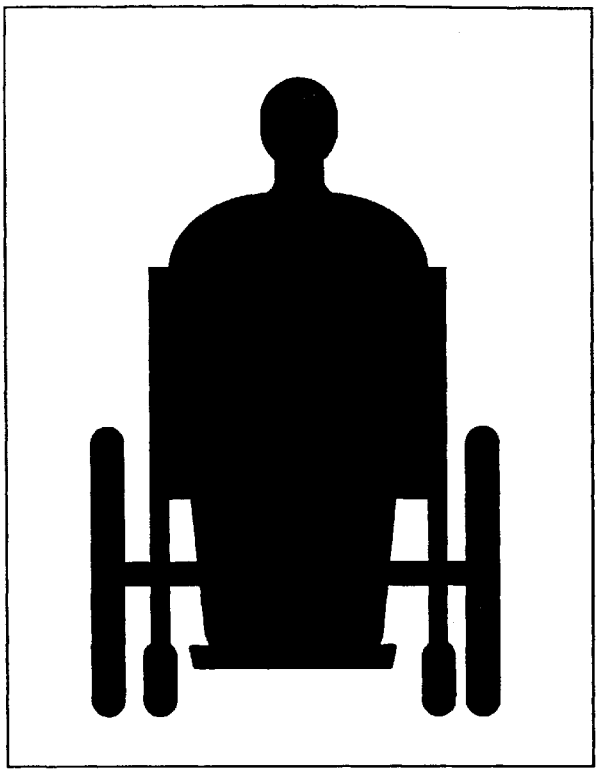
FIG. 3 is a diagram visualizing an example of information regarding a wheelchair configuration stored in a wheelchair configuration memory.
Figure 4:
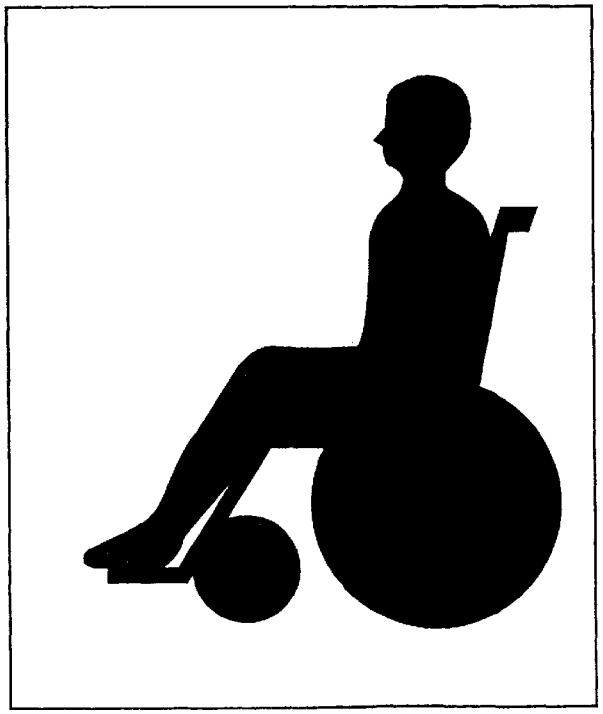
FIG. 4 is a diagram visualizing another example of information regarding a wheelchair configuration stored in the wheelchair configuration memory.

FIG. 3 and FIG. 4 show an example of visualized information regarding the configurations of diverse types of wheelchairs that has been stored in the wheelchair configuration memory 4. Passengers in wheelchairs may approach the call registerer 43 at any angle; however, by preparing a number of pieces of information regarding configurations of wheelchairs and storing them in the memory 4, such as the one shown in FIG. 3 and FIG. 4, users in wheelchairs can be recognized by comparing the differential data obtained by subjecting the current image and the background images to the image processing.

Figure 5A:
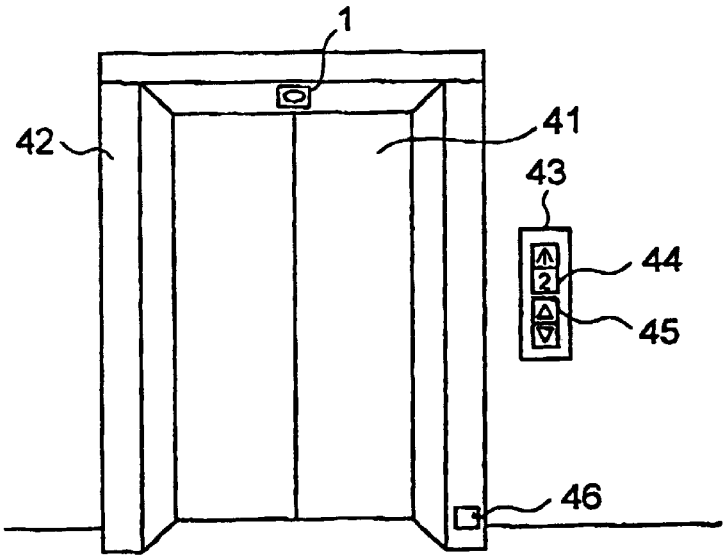
Figure 5B:
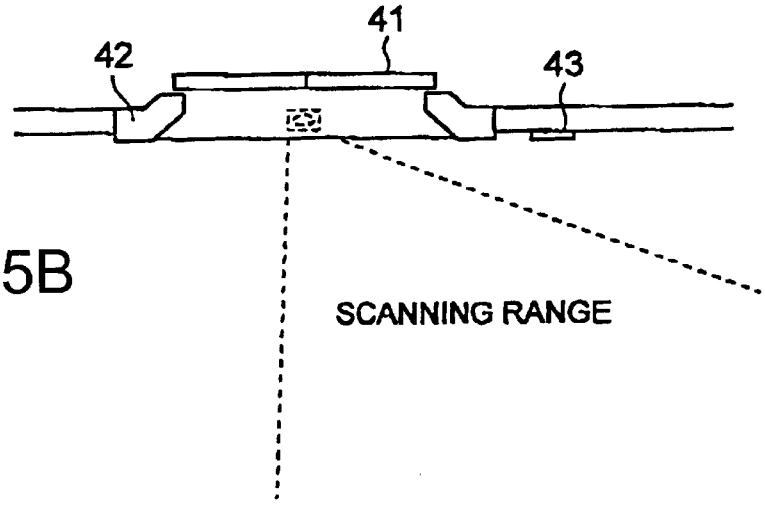
Figure 5C:
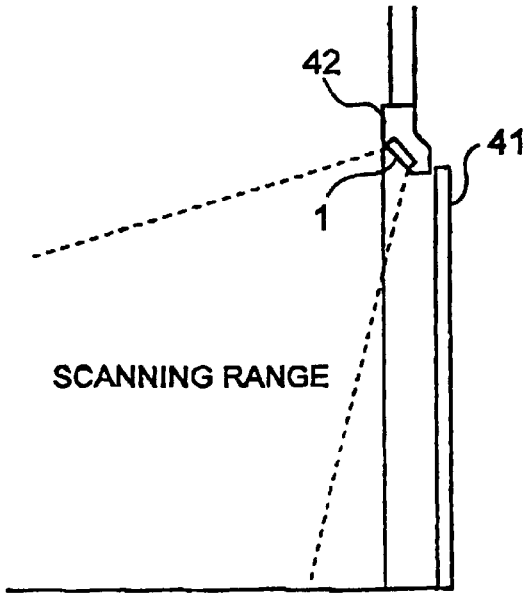

FIGS. 5A–5C show another mode of the first embodiment according to the present invention, wherein FIG. 5A is a front view of an elevator hall in which the scanning means 1 is installed on an upper frame portion of the elevator hall jamb 42, FIG. 5B is a top plan view thereof, and FIG. 5C is a side view thereof.

Figure 6A:
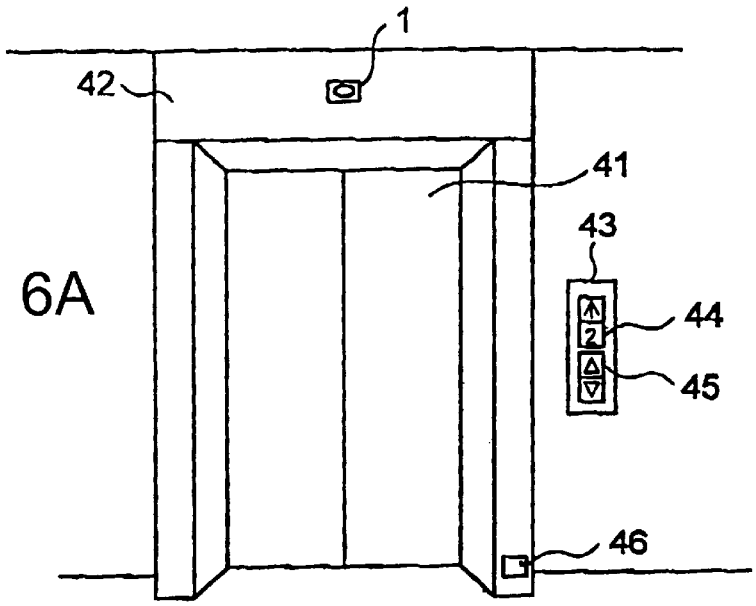
Figure 6B:
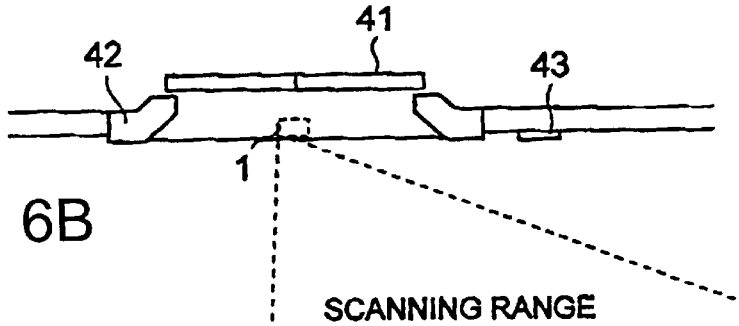
Figure 6C:
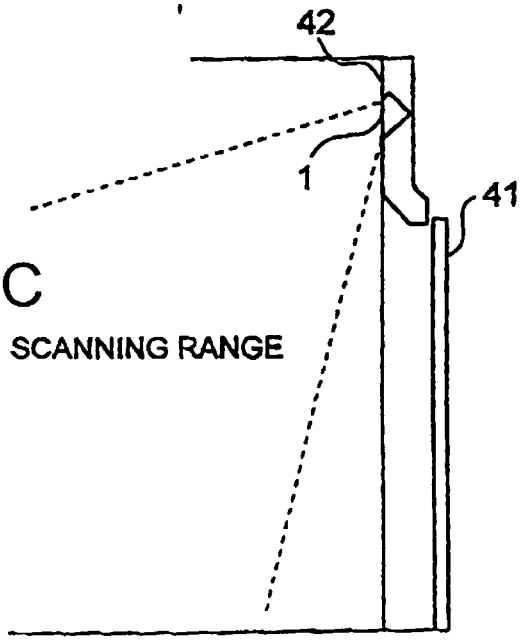

The scanning range is set so as to monitor passengers operating the hall call button device 45 from a high angle, as illustrated in the top plan view of FIG. 5B and the side view of FIG. 5C FIGS. 6A–6C show yet another mode of the first embodiment according to the present invention, wherein FIG. 6A is a front view of an elevator hall in which the scanning means 1 is installed on a transom panel constituting the upper frame of the elevator hall jamb 42, FIG. 6B is a top plan view thereof, and FIG. 6C is a side view thereof.

The scanning range is set so as to monitor passengers operating the hall call button device 45 from a high angle as illustrated in the top plan view of FIG. 6B and the side view of FIG. 6C.

Figure 7:
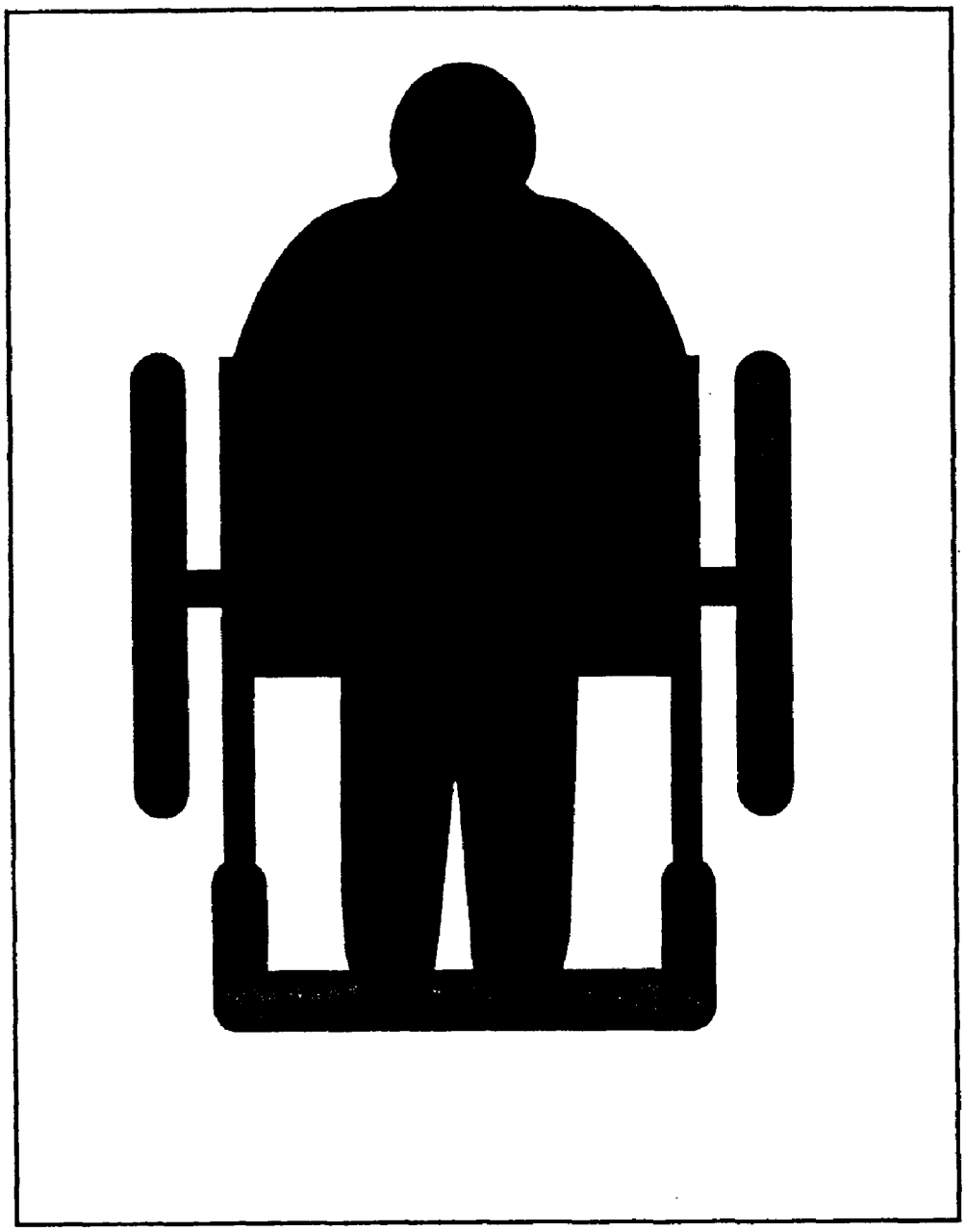
FIG. 7 is a diagram visualizing yet another example of information regarding a wheelchair configuration stored in the wheelchair configuration memory.

FIG. 7 shows an example of visualized information regarding various types of wheelchair configurations that has been stored beforehand in the wheelchair configuration memory 4, the information being based on the position of the scanning means 1 located on the upper frame of the hall jamb 42. Passengers in wheelchairs can be recognized not only by image processing of entire images of passengers in wheelchairs, but by image processing based on, for example, characteristics of wheels of wheelchairs. Moreover, since the scanning means monitors passengers from a high angle, a user in a wheelchair can be recognized even if he or she is hidden behind able-bodied users when there are a plurality of passengers, including able-bodied users at an elevator hall.

Figure 8A:
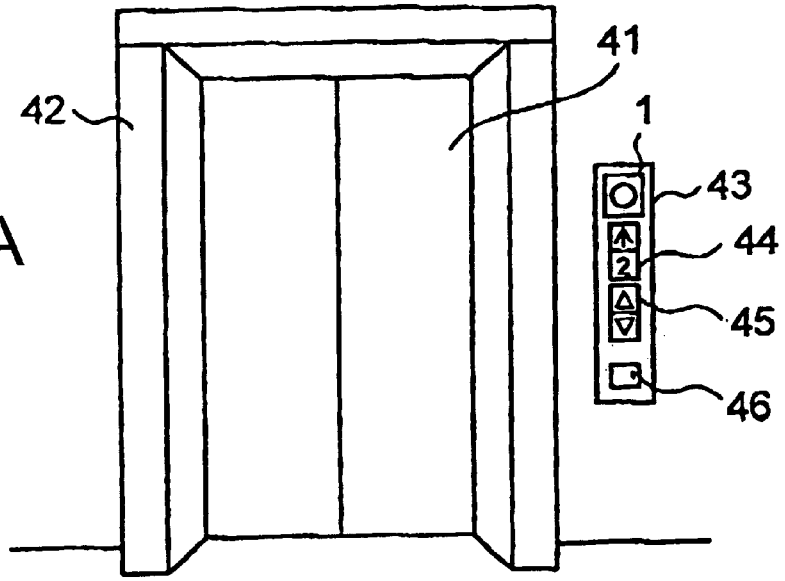
Figure 8B:
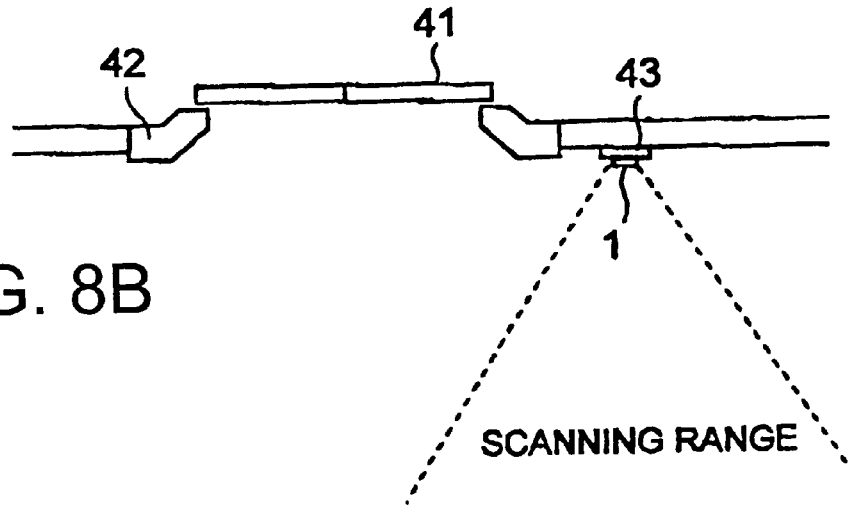

FIGS. 8A and 8B show yet another mode of the first embodiment of the present invention, wherein FIG. 8A is a front view of an elevator hall in which the scanning means 1 is incorporated in the call registerer 43 and FIG. 8B is a top plan view thereof.

In the drawings, the scanning means 1 is installed in the call registerer 43, and is located above the hall display 44 and the hall call button device 45.

Since the scanning means 1 is built in the call registerer 43, a passenger who has operated the hall call button device 45 can be monitored from a close-in distance, permitting more accurate recognition of, for example, differences between a height of an able-bodied passengers and that of a passenger in a wheelchair. This arrangement enables higher accuracy of recognition of users in wheelchairs.

The information regarding the configurations of various types of wheelchairs that is stored in the wheelchair configuration memory 4 may be the configuration information based on that illustrated in FIG. 3 and FIG. 4.

Thus, installing the scanning means 1 on the hall jamb 42 or in the call registerer 43 makes it possible to obviate the need for construction to install the scanning means 1.

Therefore, the scanning means can be factory-installed, reducing the burden of adjustment work at a site.

Furthermore, since the operation mode is automatically switched within the elevator system, there will be no need to provide a separate call button device for users in wheelchairs.

Figure 9A:
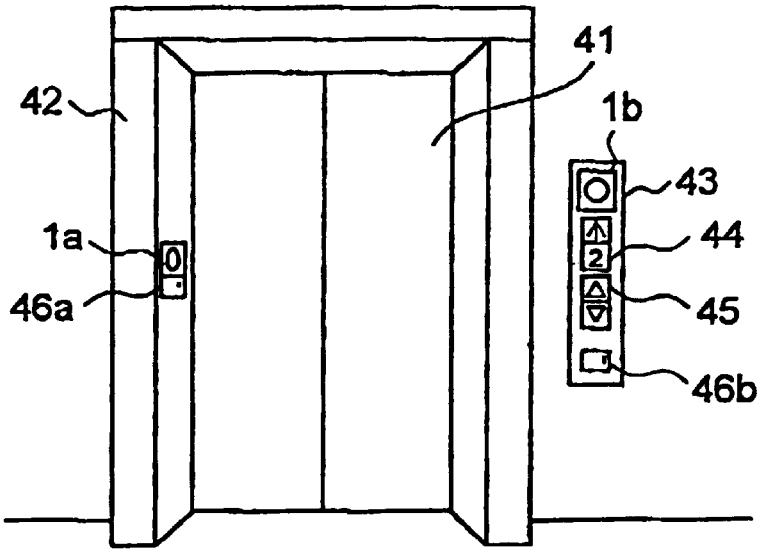
Figure 9B:
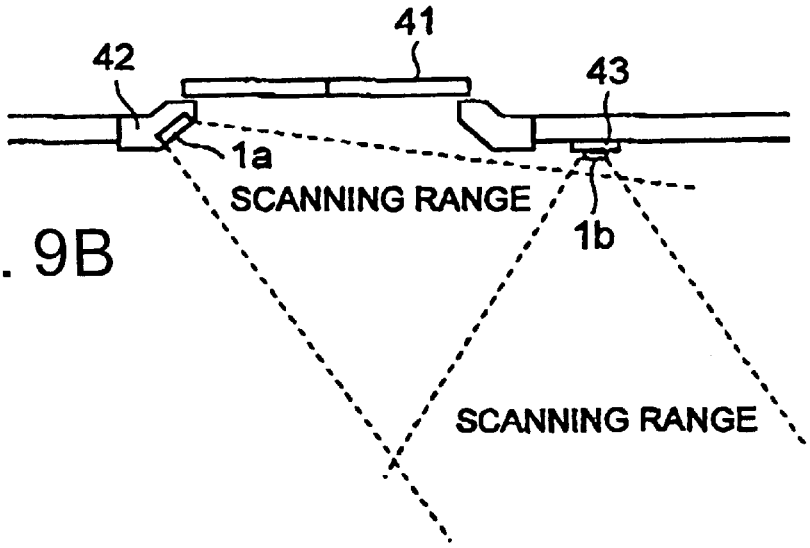

Second Embodiment,

FIGS. 9A and 9B illustrate an example wherein the scanning means 1 is installed on a vertical frame of the elevator hall jamb 42 and the call registerer 43 in a second embodiment according to the present invention. FIG. 9A is a front view of an elevator hall, and FIG. 9B is a top plan view thereof.

The second embodiment according to the present invention has two scanning means 1, the scanning range of each being set as shown in the top plan view of FIG. 9B.

The operation of the second embodiment will now be described. The operation is started when a passenger operates a hall call button device 45. Images of the passenger who has operated the hall call button 45 is captured by a scanning means 1*a* provided on an elevator hall jamb 42 and a scanning means 1*b* installed in a call registerer 43, and the captured images are stored in a current image storing means 2. Then, a wheelchair recognizing means 5 separately performs image processing on the foregoing two current images and on background images that have been stored beforehand in a background image storing means 3, and extracts two pieces of differential data.

Next, the two pieces of differential data are compared with information regarding configurations of diverse types of wheelchairs that has been stored in a wheelchair configuration memory 4 in order to determine whether the passenger who has operated the hall call button device 45 is a passenger in a wheelchair.

If a determination result indicates that the passenger is in a wheelchair, then the information is output to an operation mode selecting means 6 in an operation controller. The operation controller controls the operation in a wheelchair operation mode that has been selected by the operation mode selecting means 6.

Thus, since the current images obtained from the two directions are respectively processed to determine whether the passenger is in the wheelchair, the passenger in the wheelchair can be securely recognized even if one of the images is not satisfactory for recognition in a case where, for example, the passenger in the wheelchair is hidden behind an able-bodied passenger who has been simultaneously monitored. With this arrangement, the recognizing accuracy can be improved.

Figure 10A:
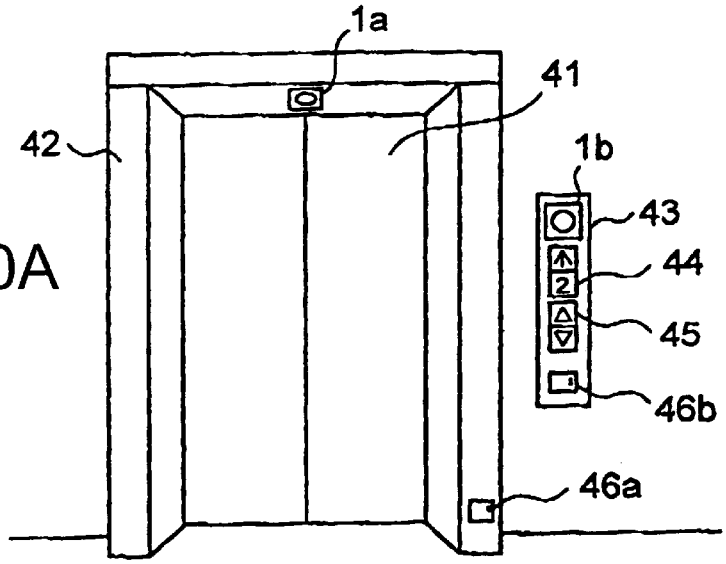
Figure 10B:
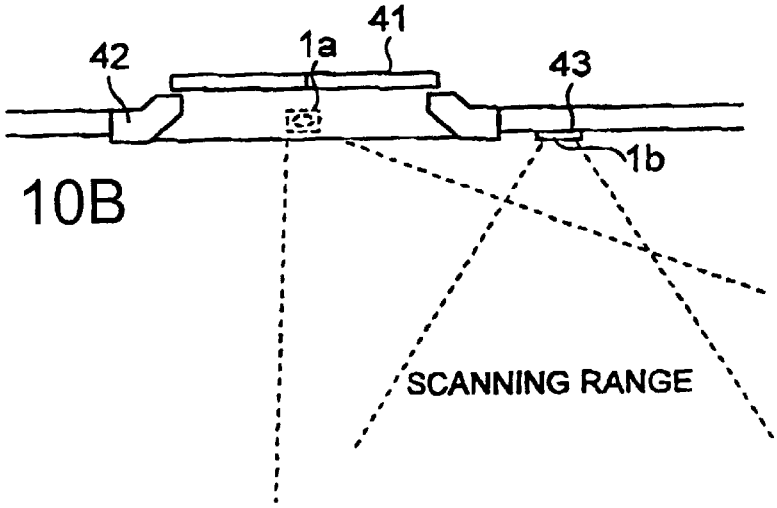
Figure 10C:
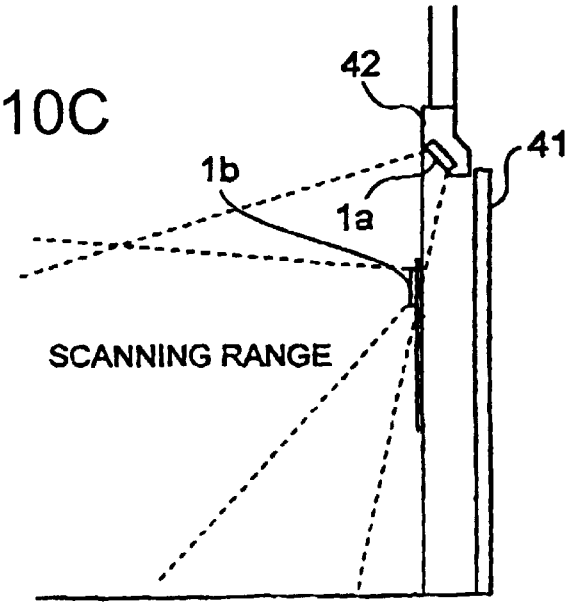

FIGS. 10A–10C show another mode of the second embodiment according to the present invention. FIG. 10A is a front view of an elevator hall showing an example wherein the scanning means 1 are installed on an upper frame of the elevator hall jamb 42 and in the call registerer 43, FIG. 10B is a top plan view thereof, and FIG. 10C is a side view thereof.

As described above, the current images captured by the two scanning means 1*a* and 1*b* from the two directions are respectively processed to determine whether the passenger is in a wheelchair. The scanning means 1*a* installed on the upper frame of the jamb captures images from a high angle; therefore, passengers in wheelchairs can be securely recognized without being affected by positional relationships between able-bodied passengers and passengers in wheelchairs when they are monitored. This arrangement permits further improved accuracy of recognition.

In FIGS. 10A–10C show if the jamb is made integral with the transom panel extending upward, then the scanning means 1 installed on the upper frame of the elevator hall jamb 42 may be mounted on the transom panel.

Third Embodiment

In the embodiments discussed above, the operations of the scanning means 1 and the image recognizing section 10 are started when a passenger operates the hall call button device 45. If the scanning means 1 and the image recognizing section 10 are set so as to be constantly in operation, then image information can be output in a real-time mode from the image output means 7 to a equipment outside the elevator system via the current image storing means 2 and the wheelchair recognizing means 5, starting with the scanning means 1.

Alternatively, only the scanning means 1 is placed in constant operation, and captured images may be directly output to external equipment in the real-time mode from the elevator system, skipping the image recognizing section 10.

With this arrangement, images can be provided in many applications, including the application of the scanning means 1 as an image terminal of a scanning system used to manage, for example, a whole building. For the conventional application for recognizing passengers in wheelchairs, setting may be made so that the operations are started when the hall call button device 45 is operated by a passenger as described above.

Furthermore, the current images from the scanning means 1, the background images, and the image processing results obtained by the wheelchair recognizing means 5 can be output from the image output means 7. Providing an image output terminal 46, which is for outputting the images to an image monitor or the like, on the elevator jamb 42 or in the call registerer 43 makes it possible to carry out initial adjustment at the time of the construction for installing the elevator system or to perform adjustment during maintenance and inspection on the field. This arrangement permits easy adjustment work.

The front views of FIGS. 2A, 5A, 8A, and 10A show examples of the disposition of the image output terminal 46. As shown in the drawings, the image output terminal 46 may be either close to or away from the scanning means 1. The image output terminal 46 is used in construction, adjustment, inspection, etc., and is unnecessary for general passengers; hence, the image output terminal 46 may be covered with a locked cover for normal operation.

Thus, the elevator system in accordance with the present invention is provided with: scanning means for scanning a hall of an elevator or an area in the vicinity thereof; an image recognizing section for recognizing an image captured by the scanning means; and operation mode selecting means for switching an operation mode of the elevator based on recognition information supplied by the image recognizing section, wherein the scanning means is installed to a jamb of an elevator hall or in an elevator hall call registerer. This arrangement makes it possible to recognize passengers in wheelchairs and automatically switch to the operation mode for passengers in wheelchairs, without involving a construction work on a building side.

The scanning means may be installed in the hall call registerer of the elevator and the jamb of the elevator hall. With this arrangement, the accuracy of recognizing passengers in wheelchairs can be enhanced by using images captured from two directions, and switching to the operation mode for passengers in wheelchairs can be automatically accomplished.

The image recognizing section may have means for transferring an image captured by the scanning means and the recognition information to external equipment. The images may alternatively be output directly from the scanning means. Thus, image information can be applied to other applications. Furthermore, an image output terminal for outputting images may be installed at any place in the hall of an elevator body to permit easy adjustment during, for example, maintenance and inspection.

What is claimed is:

1. An elevator system comprising:

scanning means installed on a vertical part of a jamb surrounding an elevator door, beside the elevator door, for scanning an elevator hall adjacent the elevator door or an area proximate the elevator hall;

an image recognizing section for recognizing an image captured by the scanning means; and operation mode selecting means for switching an operation mode of the elevator based on recognition information supplied by the image recognizing section.

2. An elevator system comprising:

scanning means installed in a hall call registerer of an elevator for scanning the elevator hall or an area proximate the elevator hall;

an image recognizing section for recognizing an image captured by the scanning means; and operation mode selecting means for switching an operation mode of the elevator based on recognition information supplied by the image recognizing section.

3. An elevator system comprising:

scanning means installed in a call registerer of an elevator hall and on a jamb of the elevator hall for scanning the elevator hall or an area proximate the elevator hall;

an image recognizing section for recognizing an image captured by the scanning means; and operation mode selecting means for switching an operation mode of the elevator based on recognition information supplied by the image recognizing section.

4. The elevator system according to claim 1, wherein the scanning means and the image recognizing section are actuated when a passenger operates a hall call registerer.

5. The elevator system according to claim 1, wherein the scanning means is in constant operation regardless of whether there is a hall call.

6. The elevator system according to claim 1, wherein the image recognizing section has means for transferring an image captured by the scanning means and the recognition information to external equipment.

7. The elevator system according to claim 1, wherein the image recognizing section has an image output terminal for outputting an image captured by the scanning means and the recognition information, the image output terminal being located at any place in a hall portion of the elevator.

8. The elevator system according to claim 2, wherein the scanning means and the image recognizing section are actuated when a passenger operates the hall call registerer.

9. The elevator system according to claim 2, wherein the scanning means is in constant operation regardless of whether there is a hall call.

10. The elevator system according to claim 2, wherein the image recognizing section has means for transferring an image captured by the scanning means and the recognition information to external equipment.

11. The elevator system according to claim 2, wherein the image recognizing section has an image output terminal for outputting an image captured by the scanning means and the recognition information, the image output terminal being located at any place in a hall portion of the elevator.

12. The elevator system according to claim 3, wherein the scanning means and the image recognizing section are actuated when a passenger operates the hall call registerer.

13. The elevator system according to claim 3, wherein the scanning means is in constant operation regardless of whether there is a hall call.

14. The elevator system according to claim 3, wherein the image recognizing section has means for transferring an image captured by the scanning means and the recognition information to external equipment.

15. The elevator system according to claim 3, wherein the image recognizing section has an image output terminal for outputting an image captured by the scanning means and the recognition information, the image output terminal being located at any place in a hall portion of the elevator.

* * * * *